US008522899B2

(12) United States Patent
Bouaphanh

(10) Patent No.: US 8,522,899 B2
(45) Date of Patent: Sep. 3, 2013

(54) WEAR RESISTANT MATERIAL AT THE SHIRTTAIL EDGE AND LEADING EDGE OF A ROTARY CONE DRILL BIT

(75) Inventor: Inpeng Bouaphanh, Carrollton, TX (US)

(73) Assignee: Varel International, Ind., L.P., Carrollton, TX (US)

( * ) Notice: Subject to any disclaimer, the term of this patent is extended or adjusted under 35 U.S.C. 154(b) by 278 days.

(21) Appl. No.: 12/896,406

(22) Filed: Oct. 1, 2010

(65) Prior Publication Data

US 2012/0080236 A1 Apr. 5, 2012

(51) Int. Cl.
*E21B 10/14* (2006.01)

(52) U.S. Cl.
USPC ..... 175/374; 175/432

(58) Field of Classification Search
USPC ..... 175/374, 336, 435, 432
See application file for complete search history.

(56) References Cited

U.S. PATENT DOCUMENTS

| | | | | |
|---|---|---|---|---|
| 3,389,761 | A | 6/1968 | Ott | |
| 3,461,983 | A * | 8/1969 | Hudson et al. | 175/375 |
| 4,421,184 | A | 12/1983 | Mullins | |
| 4,531,595 | A | 7/1985 | Housman | |
| 4,591,008 | A * | 5/1986 | Oliver | 175/227 |
| 5,074,367 | A * | 12/1991 | Estes | 175/374 |
| 5,145,016 | A * | 9/1992 | Estes | 175/331 |
| 5,289,889 | A * | 3/1994 | Gearhart et al. | 175/325.5 |
| 5,415,243 | A | 5/1995 | Lyon et al. | |
| 5,494,123 | A | 2/1996 | Nguyen | |
| 5,570,750 | A | 11/1996 | Williams | |
| 5,644,956 | A | 7/1997 | Blackman et al. | |
| 5,709,278 | A | 1/1998 | Crawford | |
| 5,975,223 | A * | 11/1999 | Karlsson | 175/374 |
| 6,116,357 | A * | 9/2000 | Wagoner et al. | 175/228 |
| 6,296,067 | B1 * | 10/2001 | Slaughter et al. | 175/228 |
| 6,336,512 | B1 | 1/2002 | Siracki et al. | |
| 6,446,739 | B1 | 9/2002 | Richman et al. | |
| 6,450,270 | B1 | 9/2002 | Saxton | |
| 6,575,350 | B2 * | 6/2003 | Evans et al. | 228/122.1 |
| 6,607,047 | B1 | 8/2003 | Swadi et al. | |
| 6,619,412 | B2 | 9/2003 | Slaughter, Jr. et al. | |
| 6,688,410 | B1 * | 2/2004 | Singh et al. | 175/374 |
| 6,955,233 | B2 | 10/2005 | Crowe et al. | |
| 7,350,600 | B2 | 4/2008 | Beuershausen et al. | |
| 7,621,347 | B2 | 11/2009 | Overstreet | |
| 8,096,373 | B2 * | 1/2012 | Patel et al. | 175/431 |
| 2002/0035895 | A1 * | 3/2002 | Davies et al. | 76/108.2 |
| 2004/0173384 | A1 * | 9/2004 | Yong et al. | 175/374 |
| 2006/0213692 | A1 * | 9/2006 | Singh et al. | 175/339 |

(Continued)

OTHER PUBLICATIONS

International Search Report and Written Opinion for PCT/US2011/054132 mailed Mar. 26, 2012 (8 pages).

*Primary Examiner* — Daniel P Stephenson
(74) *Attorney, Agent, or Firm* — Gardere Wynne Sewell LLP; Andre M. Szuwalski

(57) ABSTRACT

A rotary cone drill bit includes: a body, a leg depending from the body, a bearing shaft extending from the leg and a cone mounted to the bearing shaft. The leg includes a surface edge that is subject to wear during operation of the bit. A bottom surface of a hard material plate having an edge is attached to a conforming surface of the leg in a position where the edge of the hard material plate defines at least a portion of the surface edge of the leg. The attachment of the surfaces is made using a flowable material such as a brazing material.

50 Claims, 9 Drawing Sheets

(56) References Cited

U.S. PATENT DOCUMENTS

| | | | | |
|---|---|---|---|---|
| 2007/0163812 | A1 | 7/2007 | Overstreet et al. | |
| 2008/0202817 | A1 | 8/2008 | Massey et al. | |
| 2009/0032572 | A1* | 2/2009 | Oxfdord et al. | 228/198 |
| 2009/0038442 | A1 | 2/2009 | Shamburger et al. | |
| 2010/0071961 | A1 | 3/2010 | Steel et al. | |
| 2010/0101866 | A1 | 4/2010 | Bird | |
| 2010/0224418 | A1* | 9/2010 | Eason et al. | 175/340 |
| 2012/0080236 | A1* | 4/2012 | Bouaphanh | 175/374 |
| 2012/0080237 | A1* | 4/2012 | Bouaphanh | 175/374 |
| 2012/0080238 | A1* | 4/2012 | Bouaphanh | 175/374 |

* cited by examiner

WEAR RESISTANT MATERIAL AT THE SHIRTTAIL EDGE AND LEADING EDGE OF A ROTARY CONE DRILL BIT

CROSS-REFERENCE TO RELATED APPLICATION

The present application is related to co-pending U.S. patent application Ser. No. 12/896,484 filed Oct. 1, 2010 entitled "Wear Resistant Material for the Shirttail Outer Surface of a Rotary Cone Drill Bit", the disclosure of which is hereby incorporated by reference to the maximum extent allowable by law.

BACKGROUND

1. Technical Field of the Invention

The present invention relates to earth boring bits, and more particularly to those having rotatable cutters, also known as rotary cone drill bits.

2. Description of Related Art

Reference is made to FIGS. 1 and 2, wherein FIG. 1 illustrates an isometric view of a prior art rotary cone drill bit 10 and FIG. 2 illustrates a cross-sectional view of a portion of the prior art rotary cone drill bit 10 of FIG. 1. A leg 12 depends from a body portion 14 of the drill bit 10. The leg 12 includes a bearing shaft 16 which extends in a downward and radial inward direction. The bearing shaft 16 includes a cylindrical bearing surface 18. A cutter cone 20 is mounted to the bearing shaft 16 and supported for rotation by the bearing surface 18. In an alternative implementation, the cutter cone 20 is supported for rotation on the bearing shaft 16 by a set of roller bearings. The shape and configuration of the cone 20, as well its rotatable attachment to the bearing shaft 16, is well known in the art. In sealed bearing implementations, the bearing (journal or roller) between the cone 20 and bearing shaft 16 is lubricated by a lubricant (such as a grease) that fills regions adjacent to the bearing as well as other passages 21 in the rotary cone drill bit in a manner well known by those skilled in the art. This lubricant is retained within the rotary cone drill bit through the use of, for example, a resilient seal in the form of an o-ring 22 positioned in a seal gland 24 between the inner cylindrical surface 26 near the base of the cone 20 and the outer cylindrical surface 28 near the base of the bearing shaft 16.

The outer surface 30 of the leg 12 terminates at a semicircular edge 32 proximal to the cone 20. The region of the leg 12 associated with the surface 30 is known in the art as the "shirttail region," and the edge 32 is known in the art as the "shirttail edge." The shirttail edge 32 is provided where the terminal portion of the surface 30 transitions to an inside radial surface 34 oriented parallel to the base of the cone 20 (and perpendicular to the bearing shaft 16) and positioned at the base of the bearing shaft 16. On a rotary cone drill bit 10, one of the primary forms of bit failure can be traced back to shirttail wear. In one form of such shirttail wear, the shirttail edge 32 wears down, the radial extent of the inside radial surface 34 is decreased by this wear, and the resilient o-ring 22 seal in sealed bearings is exposed. If the bearing is instead an open (non-sealed or air) bearing, the wearing of the shirttail edge may expose the air bearing.

The prior art teaches two methods for delaying shirttail wear. FIG. 3 illustrates a first method in which a layer of welded hardfacing material 40 is applied to the surface 30 extending along at least a portion of the shirttail edge 32. The hardfacing material is typically a deposit of tungsten carbide hardmetal 40 applied to the surface 30. The material is typically pelletized tungsten carbide carried in a nickel welding medium. This solution does not work well when the rotary cone drill bit is run in a highly abrasive rock formation because the hardfacing material 40 wears down too quickly. It is primarily the welding medium, typically nickel, which accounts for the relative poor performance of the weld on material. FIG. 4 illustrates a second method in which tungsten carbide inserts 42 are press-fit into holes 44 formed in the surface 30 near the shirttail edge 32. While these inserts 42 provide better abrasion resistance (in comparison to the use of hardfacing material), the inserts 42 do not provide protection for the shirttail edge 32. The reason for this is that the holes 44 must be located at some appreciable distance from the shirttail edge 32 in order for the press-fit to function properly and peripherally retain the inserts 42. For example, a separation d1 of at least 0.125 inches is typically provided from the edge of the hole 44 to the shirttail edge 32. Thus, the method of FIG. 4 functions to primarily protect the shirttail region near to, but not exactly at, the shirttail edge 32. Furthermore, in order to be suitably retained, the press-fit inserts 42 must typically have a thickness t (with a corresponding depth of the hole 44) such that a ratio of the thickness of the insert to a diameter d' of the insert (where the inserts are round) or width w of the insert (with other shapes) exceeds about 0.5 (i.e., $t/d' \geqq 0.5$; or $t/w \geqq 0.5$).

A need accordingly exists in the art to provide an improved method of protecting the shirttail edge 32.

With reference once again to FIGS. 1 and 2, the outer surface 30 of the leg 12 in the shirttail region laterally terminates at a leading shirttail edge 50 and a trailing shirttail edge 52. The leading shirttail edge 50 is especially susceptible to wear during operation of the rotary cone drill bit 10. The prior art again teaches two methods for delaying wear of the leading shirttail edge 50. FIG. 5 illustrates a first method in which a layer of welded hardfacing material 40 is applied to the surface 30 extending along at least a portion of the leading shirttail edge 50. The hardfacing material is typically a deposit of tungsten carbide hardmetal 40. The material is typically pelletized tungsten carbide carried in a nickel welding medium. This solution does not work well when the rotary cone drill bit is run in a highly abrasive rock formation because the hardfacing material 40 wears down too quickly. It is primarily the welding medium, typically nickel, which accounts for the relative poor performance of the weld on material. FIG. 6 illustrates a second method in which tungsten carbide inserts 42 are press-fit into holes 44 formed in the surface 30 near the leading shirttail edge 50. While these inserts 42 provide better abrasion resistance (in comparison to the use of hardfacing material), the inserts 42 do not provide protection for the leading shirttail edge 50. The reason for this is that the holes 44 must be located at some appreciable distance from the leading shirttail edge 50 in order for the press-fit to function properly and peripherally retain the inserts 42. For example, a separation d2 of at least 0.125 inches is typically provided from the edge of the hole 44 to the leading edge 50. Thus, the method of FIG. 6 functions to primarily protect the shirttail region near to, but not exactly at, the leading shirttail edge 50. Furthermore, in order to be suitably retained, the press-fit inserts 42 must typically have a thickness t (with a corresponding depth of the hole 44) such that a ratio of the thickness of the insert to a diameter d' of the insert (where the inserts are round) or width w of the insert (with other shapes) exceeds about 0.5 (i.e., $t/d' \geqq 0.5$; or $t/w \geqq 0.5$).

Although not explicitly shown in FIGS. 5 and 6, the protection mechanisms shown could alternatively, or additionally, be provided on the leading side surface 54 of the leg 12.

This leading side surface 54 is adjacent the outer surface 30 of the leg 12 at the leading shirttail edge 50.

A need thus exists in the art to provide an improved method of protecting the leading shirttail edge 50 and leading side surface 54 of the shirttail.

SUMMARY

In an embodiment, a rotary cone drill bit comprises: a body, a leg depending from the body, a bearing shaft extending from the leg and a cone mounted to the bearing shaft. The leg terminates at a shirttail edge adjacent a base of the cone. A bottom surface of a hard material plate having an edge is attaching to a substantially conforming surface of the leg in a position where the edge of the hard material plate defines at least a portion of the shirttail edge.

In an embodiment, a rotary cone drill bit comprises: a body, a leg depending from the body, a bearing shaft extending from the leg and a cone mounted to the bearing shaft. The leg includes a lateral leading edge. A bottom surface of a hard material plate having an edge is attached to a substantially conforming surface of the leg in a position where the edge of the hard material plate defines at least a portion of the lateral leading edge.

In an embodiment, a rotary cone drill bit comprises: a body, a leg depending from the body, a bearing shaft extending from the leg and a cone mounted to the bearing shaft. The leg includes a surface edge that is subject to wear during operation of the bit. A bottom surface of a hard material plate having an edge is attached to a substantially conforming surface of the leg in a position where the edge of the hard material plate defines at least a portion of the surface edge of the leg.

In any of the foregoing embodiments, the conforming surface to which attachment is made may comprise: a floor surface formed in or by an outer shirttail surface of the leg, a floor surface formed in or by a leading side surface of the leg, a floor surface of a slot formed in the outer shirttail surface of the leg, or a floor surface of a slot formed in the leading side surface of the leg.

In any of the foregoing embodiments, a material for attaching the hard material plate may comprise a flowable adhesive material interposed between the bottom surface of the hard material plate to the floor surface of the leg. That material may comprise, for example, a brazing material.

In any of the foregoing embodiments, the hard material plate may comprise polycrystalline diamond compact, or be made of a material such as solid tungsten carbide, or comprise a polycrystalline cubic boron nitride compact, or comprise an impregnated diamond segment.

BRIEF DESCRIPTION OF THE DRAWINGS

Other features and advantages of the invention will become clear in the description which follows of several non-limiting examples, with references to the attached drawings wherein.

DETAILED DESCRIPTION OF THE DRAWINGS

Figure 7:
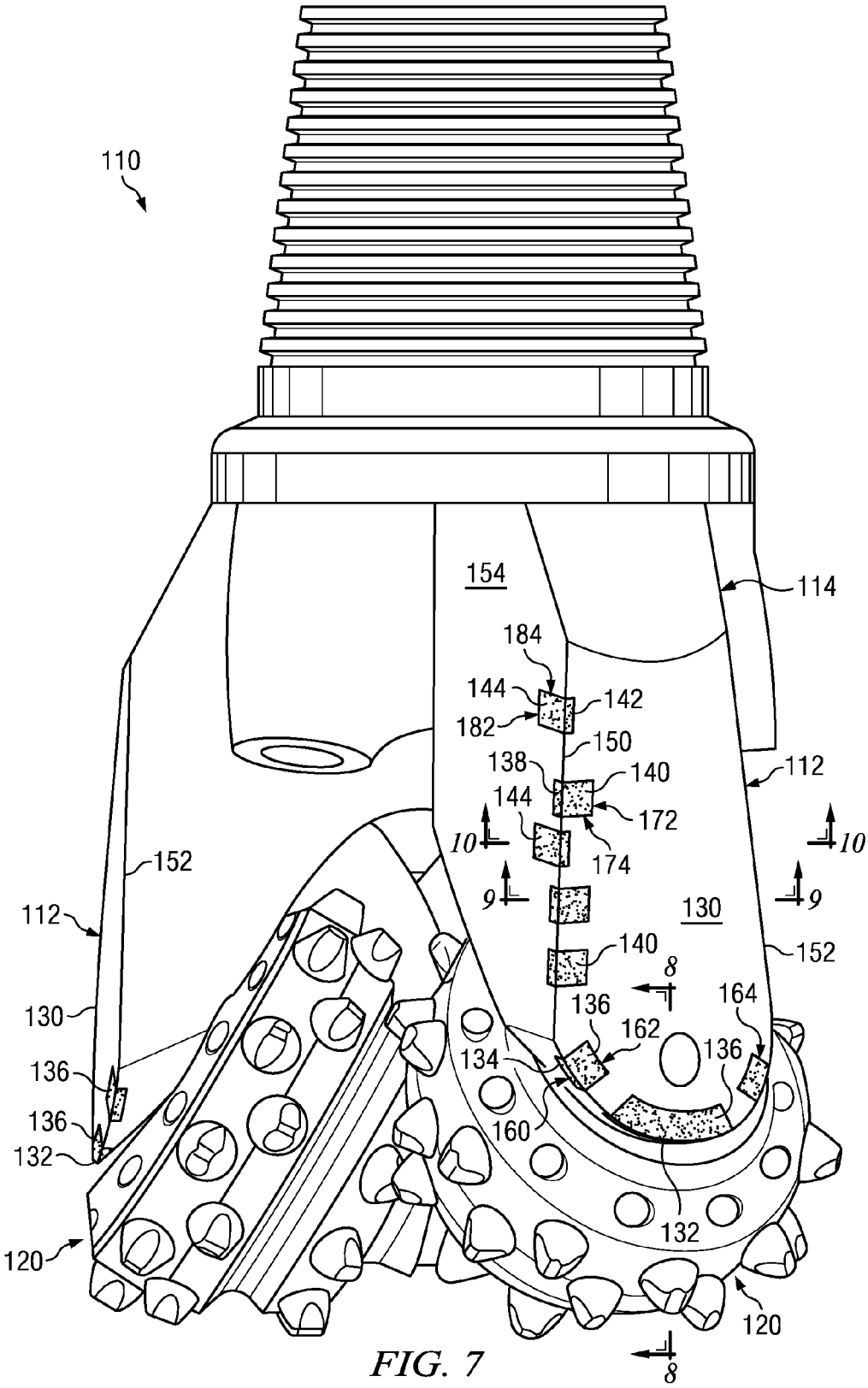
FIG. 7 illustrates an isometric view of a rotary cone drill bit including protection mechanisms for the shirttail edge and the leading edge of the shirttail.

Reference is now made to FIG. 7 which illustrates an isometric view of a rotary cone drill bit 110 including protection mechanisms for the shirttail edge and the leading edge (also referred to as the lateral leading edge) of the shirttail. A leg 112 depends from a body portion 114 of the drill bit 110. The leg 112 includes a bearing shaft (not shown, see FIG. 8 reference 116) which extends in a downward and radial inward direction. A cutter cone 120 is mounted to the bearing shaft and supported thereon for rotation. The outer surface 130 of the leg 112 terminates at a semicircular edge 132 proximal to the cone 120. The region of the leg 112 associated with the surface 130 is known in the art as the "shirttail region," and the edge 132 is known in the art as the "shirttail edge." The outer surface 130 of the leg 112 laterally terminates at a leading shirttail edge 150 and a trailing edge 152 of the shirttail. The lateral leading edge 150 and lateral trailing edge 152 of the shirttail comprise extensions of the shirttail edge 132 extending along the length of the leg 112. The shirttail region further includes a leading side surface 154 which is adjacent the outer surface 130 of the leg 112 at the leading shirttail edge 150. Although illustrated for example as including a sealed bearing system, it will be understood that the present invention is applicable to both sealed and non-sealed (air) bearing bits.

To protect the shirttail edge 132, a slot 134 is provided in the outer surface 130 of the leg 112 extending inwardly from the shirttail edge 132, and a hard plate insert 136 is adhered to a floor surface within the slot 134. See, also, FIG. 8. To protect the lateral leading edge 150 of the shirttail, a slot 138 is provided in the outer surface 130 of the leg 112 extending inwardly from the leading edge 150 of the shirttail, and a hard plate insert 140 is adhered to a floor surface within the slot 138. See, also, FIG. 9. To protect the leading side surface 154, a slot 142 is provided in the leading side surface 154 of the leg 112 extending outwardly from the leading edge 150 of the shirttail, and a hard plate insert 144 is adhered to a floor surface within the slot 142. See, also, FIG. 10. The slots may be milled or cast into the outer surface 130 and/or leading side surface 154 of the leg 112 at desired positions, specifically positions on the leg which are susceptible to wear during operation of the bit, and may have flat or curved floor surface geometries as desired and which conform with the bottom surfaces of the inserts 136, 140 and 144.

Although all three protection mechanisms are illustrated in FIG. 7, it will be understood that any one or more of the illustrated protection mechanisms may be selected for use on the rotary cone drill bit 110. Although FIG. 7 illustrates the use of several hard plate inserts 136 along the shirttail edge 132, it will be understood that one slot 134 could instead be provided extending along all or a portion of the shirttail edge 132, with a single hard plate insert 136 adhered within the slot 134. Although FIG. 7 illustrates the use of several hard plate inserts 140 along the leading edge 150 of the shirttail, it will be understood that one slot 138 could instead be provided extending along all or a portion of the leading edge 150 of the shirttail, with a single hard plate insert 140 adhered within the slot 138. Although FIG. 7 illustrates the use of several hard plate inserts 144 along the leading edge 150 of the shirttail, it will be understood that one slot 142 could instead be provided extending along all or a portion of the leading edge 150 of the shirttail, with a single hard plate insert 144 adhered within the slot 142. In each of the foregoing implementations, the portion of the edge (shirttail edge 132 and/or leading shirttail edge 150) selected to receive protection would be that portion of the edge which is most susceptible to wear during operation of the rotary cone drill bit 110.

Figure 8:
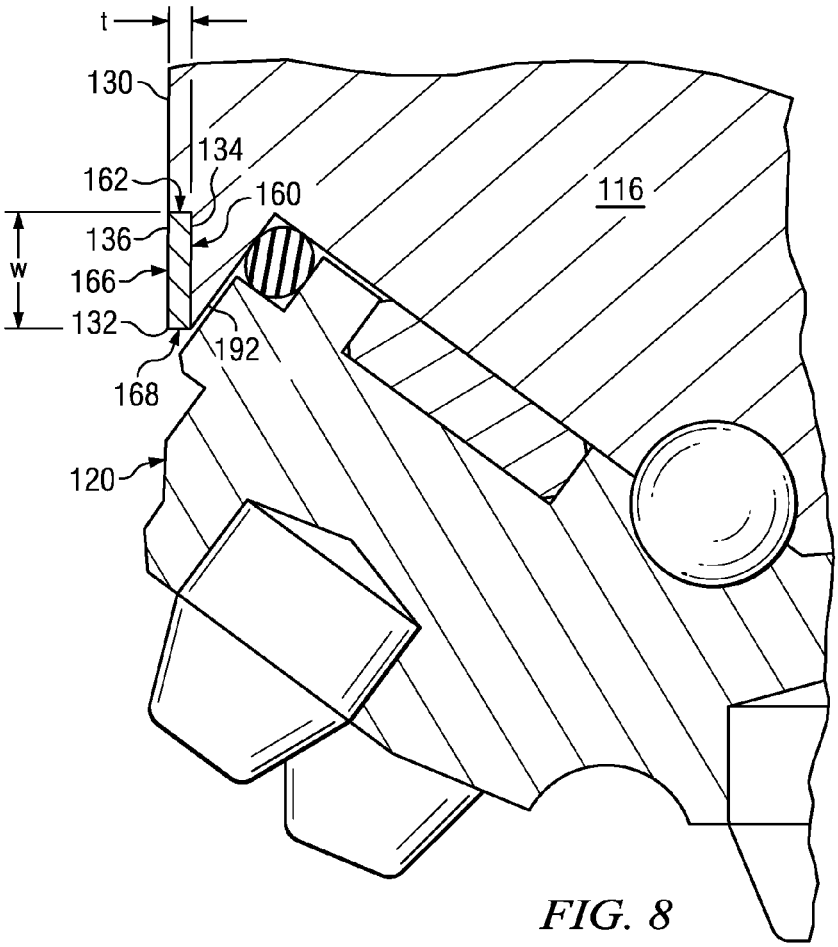
FIG. 8 illustrates a cross-sectional view of a portion of a leg of a rotary cone drill bit which includes an embodiment of a shirttail edge protection mechanism.

Reference is now made to FIG. 8 which illustrates a cross-sectional view of a portion of a leg of a rotary cone drill bit which includes an embodiment of a shirttail edge protection mechanism. In this embodiment, the slot 134 is provided in the outer surface 130 of the leg 112 extending inwardly from the shirttail edge 132. The slot 134 may be milled or cast into the outer surface 130 of the leg 112. The slot 134 is defined by a floor surface 160, a rear wall 162 and two side walls 164 (see, also, FIG. 7). The floor surface 160 may, for example, be a substantially flat surface, or alternatively a curved surface. The hard plate insert 136 is adhered within the slot 134. In a preferred embodiment, a bottom surface of hard plate insert is adhered to a substantially conforming floor surface 160 of the slot 134. The bottom surface of the insert may, for example, comprise a flat surface which conforms with the flat floor surface, or have a curved surface conforming to the curved floor surface. The means for adhering the bottom surface to the floor surface may, for example, comprise any suitable adhering material which is interposed between the substantially conforming (for example, parallel) surfaces including adhesive material flowable between the substantially conforming surfaces by capillary action such as a brazing material, solder, adhesives, resins, and the like (see, for example, U.S. Patent Application Publication No. 2009/0038442, the disclosure of which is hereby incorporated by reference). Because of drawing scale, the adhesive material is not explicitly shown in FIG. 8, but it will be understood that the adhesive material is present between the conforming bottom surface and floor surface. The adhesive material preferably has a substantially uniform thickness between the conforming bottom surface and floor surface. The hard plate insert 136 has a thickness such that when adhered within the slot 134, a top surface 166 of the plate insert 136 is substantially flush with, or slightly exposed beyond, or slightly recessed below, the outer surface 130 of the leg 112. Furthermore, the hard plate insert 136 is sized such that an edge 168 of the plate insert opposite the rear wall 162 of the slot 134 defines (or is coincident with or nearly coincident with) the shirttail edge 132. The hard plate insert 136 is made of a material or combination of materials which are more abrasion resistant than the material used to make the leg and shirttail of the bit. In a preferred implementation, the hard plate insert is made of a material such as solid tungsten carbide, polycrystalline diamond compact (PDC), polycrystalline cubic boron nitride compactim-pregnated diamond segment, and the like. These materials are superior to the traditional weld on tungsten carbide hardfacing known in the prior art because they are denser and are not as susceptible to abrasion and erosion.

The shirttail edge 132 is provided where the terminal portion of the surface 130 transitions to an inside radial surface 192 oriented parallel to the base of the cone 120 (perpendicular to the bearing shaft 116) and positioned at the base of the bearing shaft 116. The hard plate inserts 136 function to protect against wearing of the shirttail edge 132 and erosion of the inside radial surface 192. Although a sealed bearing system is illustrated, it will be understood that edge protection in accordance with the present invention is applicable to both sealed and non-sealed (air) bearing bits.

Figure 1:
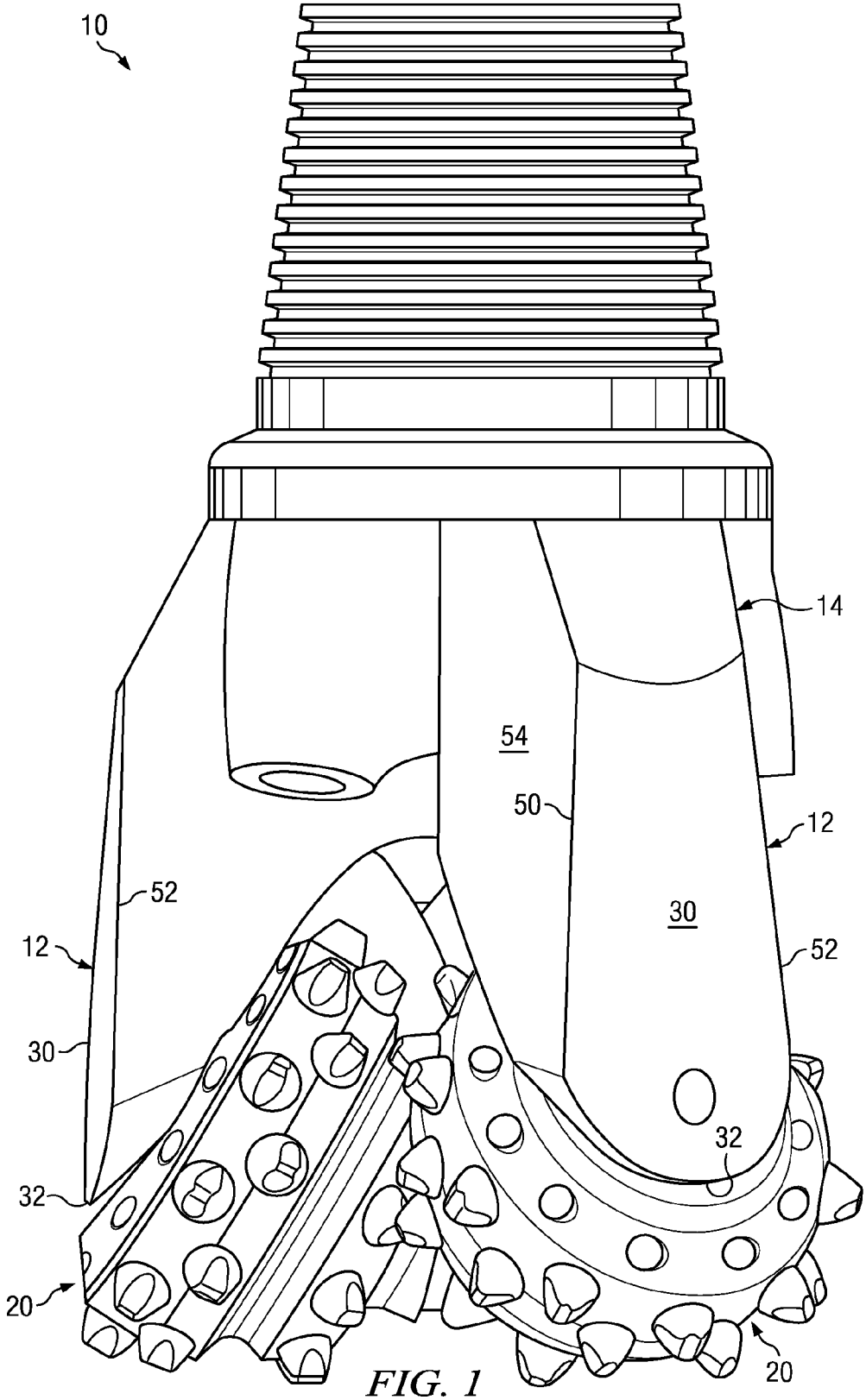
FIG. 1 (PRIOR ART)
FIG. 1 illustrates an isometric view of a prior art rotary cone drill bit.
Figure 2:
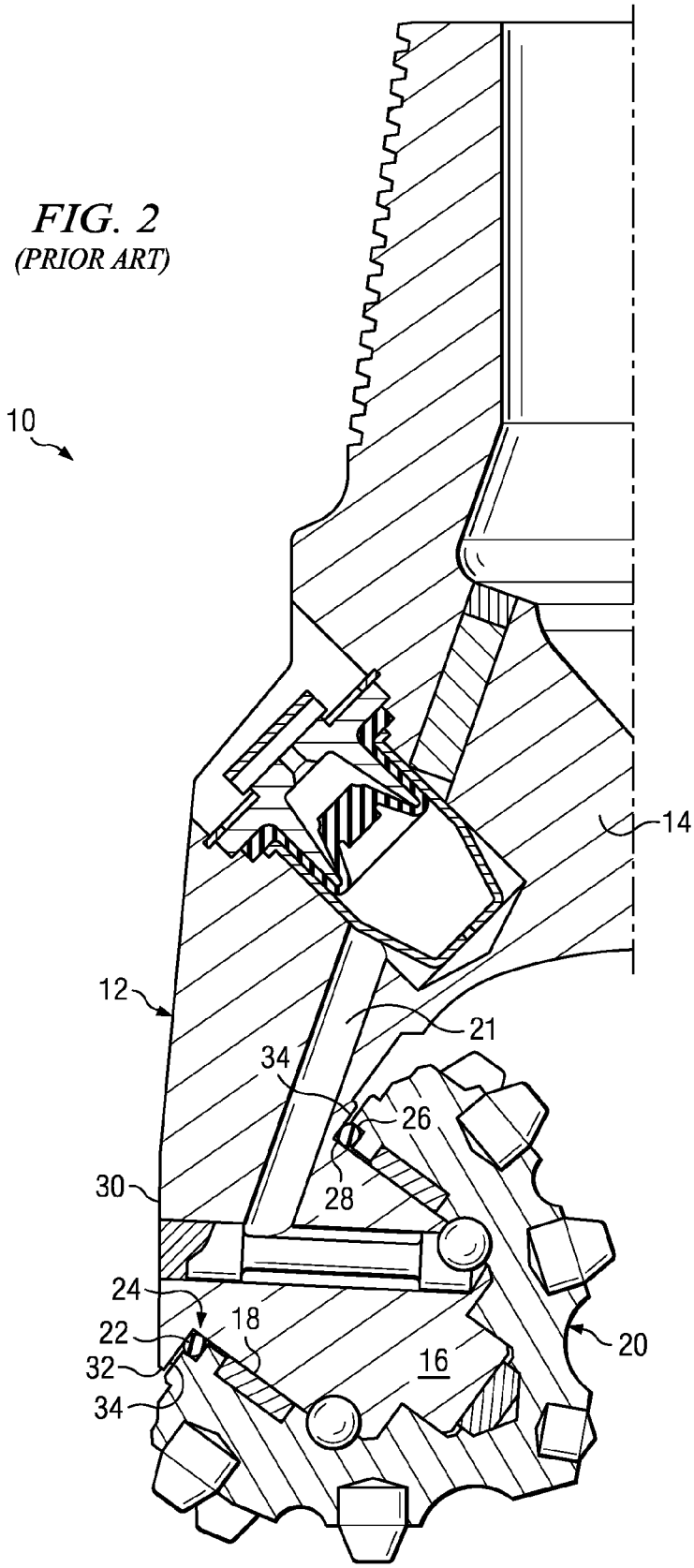
FIG. 2 (PRIOR ART)
FIG. 2 illustrates a cross-sectional view of a portion of a leg of the prior art rotary cone drill bit of FIG. 1.
Figure 4:
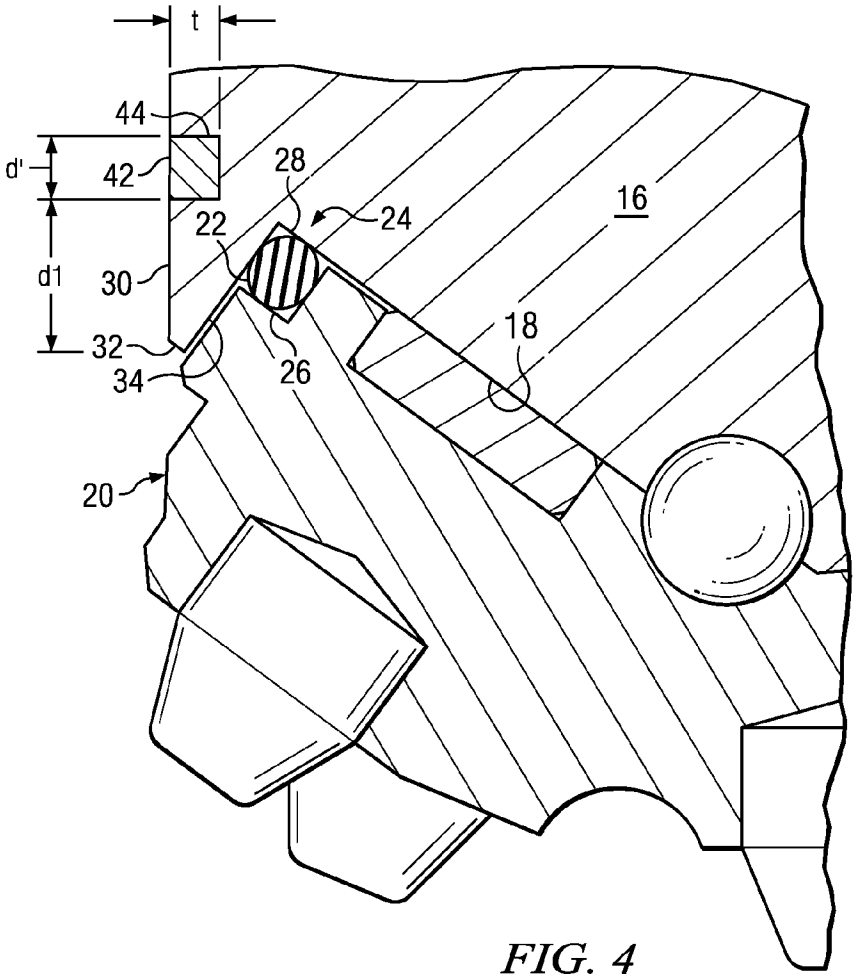
FIG. 4 (PRIOR ART)
FIG. 4 illustrates the use of tungsten carbide inserts near the shirttail edge.
Figure 3:
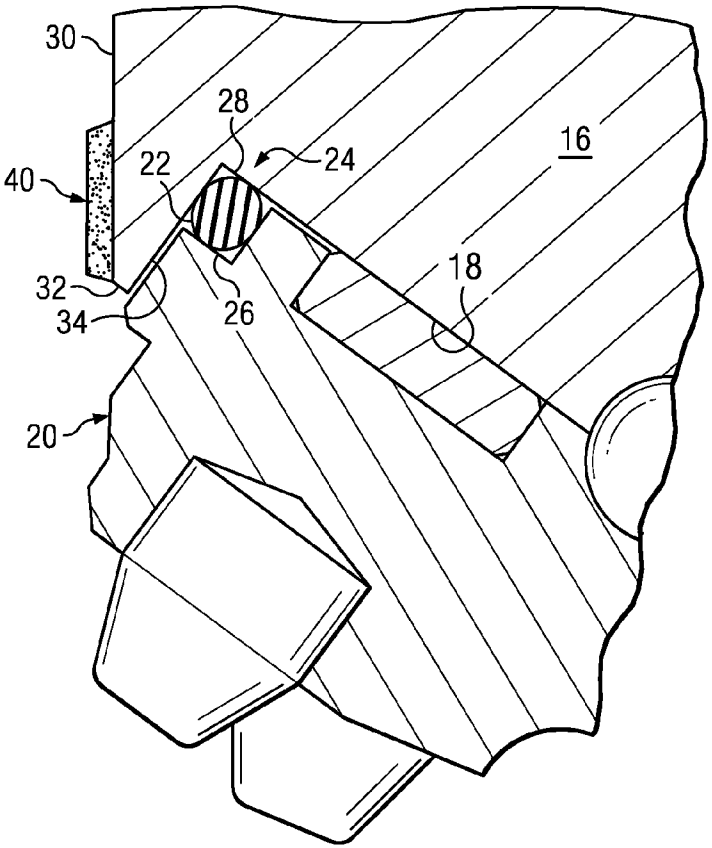
FIG. 3 (PRIOR ART)
FIG. 3 illustrates application of a layer of hardfacing material extending along at least a portion of the shirttail edge.
Figure 5:
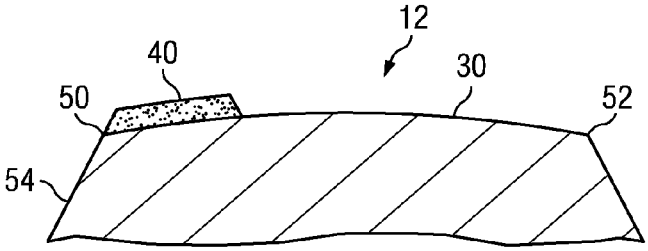
FIG. 5 (PRIOR ART)
FIG. 5 illustrates application of a layer of hardfacing material extending along at least a portion of the leading edge of the shirttail.
Figure 6:
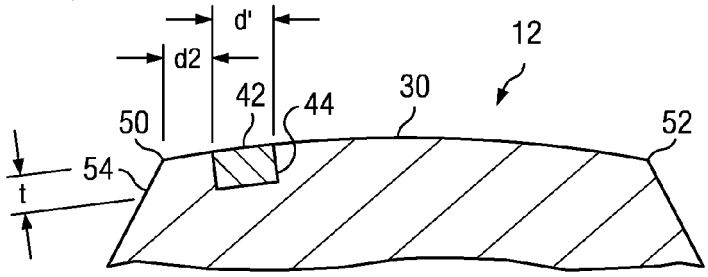
FIG. 6 (PRIOR ART)
FIG. 6 illustrates the use of tungsten carbide inserts near the leading edge of the shirttail.

The hard plate inserts 136 have a thickness t and width w (wherein the width is measured in a direction perpendicular to the shirttail edge 132). The hard plate inserts 136 are thin inserts. In this case, a ratio of the thickness t of the insert to a width w of the insert is less than 0.5 (i.e., $t/w<0.5$). More particularly, the ratio of the thickness t of the insert to the width w of the insert is substantially less than 0.5 (i.e., $t/w<<0.5$). Even more particularly, the ratio of the thickness t of the insert to the width w of the insert is less than 0.2 (i.e., $t/w<0.2$), and may even be less than 0.1 (i.e., $t/w<0.1$). This is permitted because the hard plate inserts 136 are retained by adhesion to their bottom surface and not their peripheral edge (as is the case with the press-fit inserts used in the prior art (see, FIG. 4)).

Figure 12:
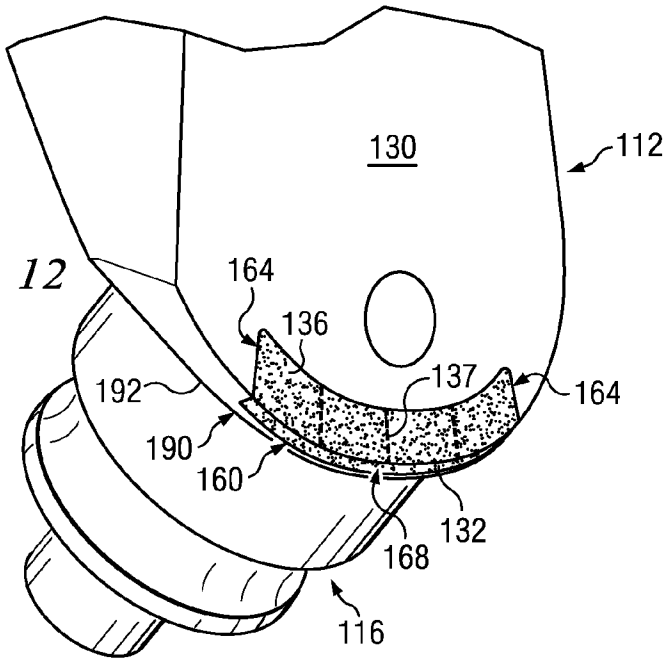
FIGS. 11 and 12 illustrate isometric views of a portion of the leg and including protection mechanisms for the shirttail edge.
Figure 11:
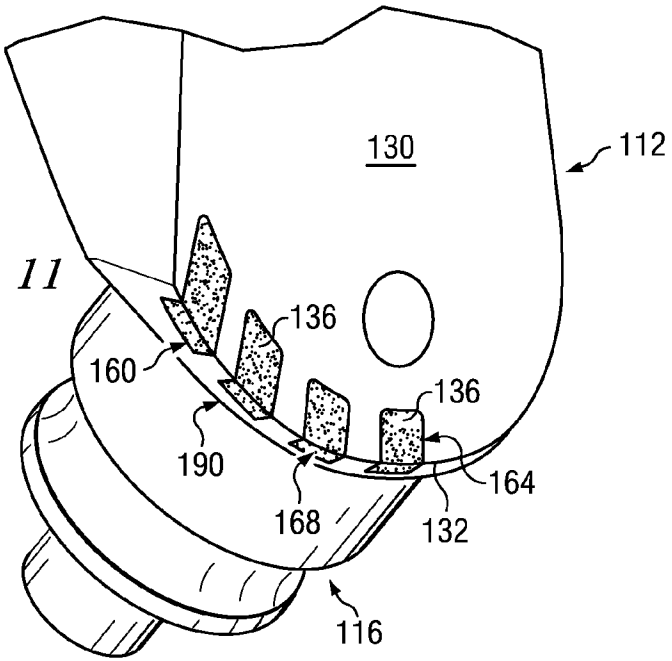

FIGS. 11 and 12 illustrate isometric views of a portion of the leg 130 and including protection mechanisms for the shirttail edge 132 as shown in FIG. 8. The cone 120 has been omitted from FIGS. 11 and 12 to show how the hard plate inserts 136 are positioned at the shirttail edge 132. FIGS. 11 and 12 further show how the slots 134 are provided in the outer surface 130 of the leg 112 extending inwardly from the shirttail edge 132. A portion 190 of the shirttail material remains at the floor surface 160 of each slot 134 (adjacent the inside radial surface 192), and it is at the floor surface 160 where adhesion (for example, through brazing) is made to the hard plate insert 136. In this way, the adhesive material is not externally exposed and subject to possible wear. The insert may have a thickness in the range of 0.050 to 0.500 inches.

As shown in FIG. 12, where the protection is desired to extend in a continuous manner along an extended length of the shirttail edge 132, the slot likewise extends in a continuous manner along that extended length of the edge 132. In one embodiment, the floor surface may curve with the radius of the bit, and thus the bottom surface of the one or more included inserts will have a conforming curve. In another embodiment, the slot is formed to include a plurality of substantially flat and adjacent floor surfaces 160, and a hard plate insert 136 with a conforming flat bottom surface is provided for each flat surface and inserts are arranged in a tiled edge-to-edge configuration (see, dotted line reference 137 indicating adjacent tile edges).

Figure 9:
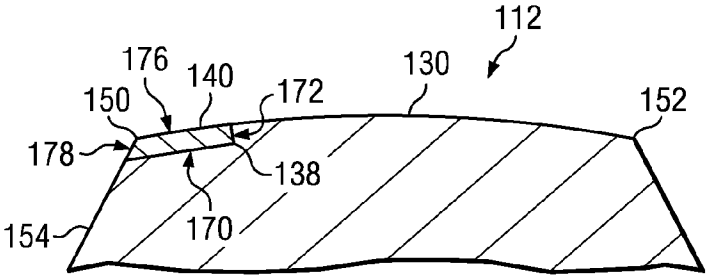

Reference is now made to FIG. 9 which illustrates a cross-sectional view of a portion of a leg of a rotary cone drill bit which includes an embodiment of a protection mechanism for the lateral leading edge of the shirttail. In this embodiment, the slot 138 is provided in the outer surface 130 of the leg 112 extending inwardly from the lateral leading edge 150 of the shirttail. The slot 138 may be milled or cast into the outer surface 130 of the leg 112. The slot 138 is defined by a floor surface 170, a rear wall 172 and two side walls 174 (see, also, FIG. 7). The hard plate insert 140 is adhered within the slot 138. In a preferred embodiment, a bottom surface of hard plate insert is adhered to the floor surface 170 of the slot 138. The means for adhering the bottom surface to the floor surface may, for example, comprise any suitable adhering material which is interposed between the substantially conforming (for example, parallel) surfaces including adhesive material flowable between the substantially conforming surfaces by capillary action such as a brazing material, solder, adhesives, resins, and the like (see, for example, U.S. Patent Application Publication No. 2009/0038442, the disclosure of which is hereby incorporated by reference). Because of drawing scale, the adhesive material is not explicitly shown in FIG. 9, but it will be understood that the adhesive material is present between the bottom surface and the floor surface. The adhesive material preferably has a substantially uniform thickness between the conforming bottom surface and floor surface. The hard plate insert 140 has a thickness such that when adhered within the slot 138, a top surface 176 of the plate insert 140 is substantially flush with, or slightly exposed beyond, or slightly recessed below, the outer surface 130 of the leg 112. Furthermore, the hard plate insert 140 is sized such that an edge 178 of the plate insert opposite the rear wall 172 of the slot 138 defines (or is coincident with or nearly coincident with) the leading edge 150 (leading surface 154) of the shirttail. The hard plate insert 140 is made of a material or combination of materials which are more abrasion resistant than the material used to make the leg and shirttail of the bit. In a preferred implementation, the hard plate insert is made of a material such as tungsten carbide, polycrystalline diamond compact (PDC), polycrystalline cubic boron nitride compactimpregnated diamond segment, and the like. These materials are superior to the traditional weld on tungsten carbide hardfacing known in the prior art because they are denser and are not as susceptible to abrasion and erosion. Again, the adhesive material is this implementation is not externally exposed and subject to possible wear.

The hard plate inserts 140 have a thickness t and width w (wherein the width is measured in a direction perpendicular to the leading edge 150). The hard plate inserts 140 are thin inserts. In this case, a ratio of the thickness t of the insert to a width w of the insert is less than 0.5 (i.e., $t/w<0.5$). More particularly, the ratio of the thickness t of the insert to the width w of the insert is substantially less than 0.5 (i.e., $t/w<<0.5$). Even more particularly, the ratio of the thickness t of the insert to the width w of the insert is less than 0.2 (i.e., $t/w<0.2$), and may even be less than 0.1 (i.e., $t/w<0.1$). This is permitted because the hard plate inserts 140 are retained by adhesion to their bottom surface and not their peripheral edge (as is the case with the press-fit inserts used in the prior art (see, FIG. 4).

Figure 10:
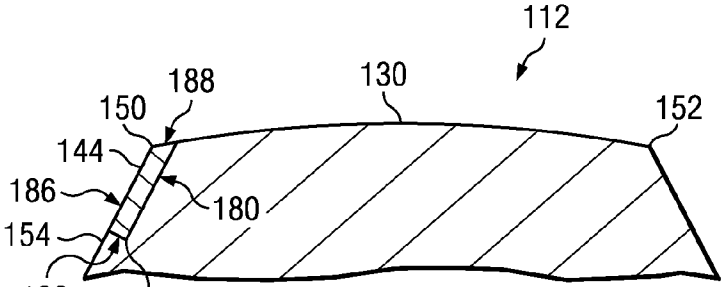
FIGS. 9 and 10 illustrate cross-sectional views of a portion of a leg of a rotary cone drill bit which include embodiments of a mechanism for protecting the leading edge of the shirttail.

Reference is now made to FIG. 10 which illustrates a cross-sectional view of a portion of a leg of a rotary cone drill bit which includes an embodiment of a protection mechanism for the lateral leading edge of the shirttail. In this embodiment, the slot 142 is provided in the leading side surface 154 of the leg 112 extending outwardly from the lateral leading edge 150 of the shirttail. The slot 142 may be milled or cast into the leading side surface 154 of the leg 112. The slot 142 is defined by a floor surface 180, a rear wall 182 and two side walls 184 (see, also, FIG. 7). The hard plate insert 144 is adhered within the slot 142. In a preferred embodiment, a bottom surface of hard plate insert is adhered to the floor surface 180 of the slot 142. The means for adhering the bottom surface to the floor surface may, for example, comprise any suitable adhering material which is interposed between the substantially conforming (for example, parallel) surfaces including adhesive material flowable between the substantially conforming surfaces by capillary action such as a brazing material, solder, adhesives, resins, and the like (see, for example, U.S. Patent Application Publication No. 2009/0038442, the disclosure of which is hereby incorporated by reference). The adhesive material preferably has a substantially uniform thickness between the conforming bottom surface and floor surface. Because of drawing scale, the adhesive material is not explicitly shown in FIG. 10, but it will be understood that the adhesive material is present between the bottom surface and the floor surface. The hard plate insert 144 has a thickness such that when adhered within the slot 142, a top surface 186 of the plate insert 144 is substantially flush with, or slightly exposed beyond, or slightly recessed below, the leading side surface 154 of the leg 112. Furthermore, the hard plate insert 144 is sized such that edge 188 of the plate insert opposite the rear wall 172 of the slot 138 defines (or is coincident with or nearly coincident with) the leading edge 150 (outer surface 130) of the shirttail. The hard plate insert 140 is made of a material or combination of materials which are more abrasion resistant than the material used to make the leg and shirttail of the bit. In a preferred implementation, the hard plate insert is made of a material such as tungsten carbide, polycrystalline diamond compact (PDC), polycrystalline cubic boron nitride compact impregnated diamond segment, and the like. These materials are superior to the traditional weld on tungsten carbide hardfacing known in the prior art because they are denser and are not as susceptible to abrasion and erosion. Again, the adhesive material is this implementation is not externally exposed and subject to possible wear.

The hard plate inserts 144 have a thickness t and width w (wherein the width is measured in a direction perpendicular to the leading edge 150). The hard plate inserts 144 are thin inserts. In this case, a ratio of the thickness t of the insert to a width w of the insert to is less than 0.5 (i.e., $t/w<0.5$). More particularly, the ratio of the thickness t of the insert to the width w of the insert is substantially less than 0.5 (i.e., $t/w<<0.5$). Even more particularly, the ratio of the thickness t of the insert to the width w of the insert is less than 0.2 (i.e., $t/w<0.2$), and may even be less than 0.1 (i.e., $t/w<0.1$). This is permitted because the hard plate inserts 144 are retained by adhesion to their bottom surface and not their peripheral edge (as is the case with the press-fit inserts used in the prior art (see, FIG. 4).

It will be noted that the slots and plate inserts may be of any selected geometry thus allowing for the application of protection to complex surfaces of the bit. Tiling of the inserts edge-to-edge permits the application of protection to be extended continuously over a complex curved surface. Alternatively, a single insert with a complex curved bottom surface could be provided.

The illustration of protection being applied using slots and plate inserts at the shirttail edge and/or leading shirttail edge is by way of example only, it being understood that the protection mechanisms described can be applied to any edges of the bit that are susceptible to wear.

Figure 13:
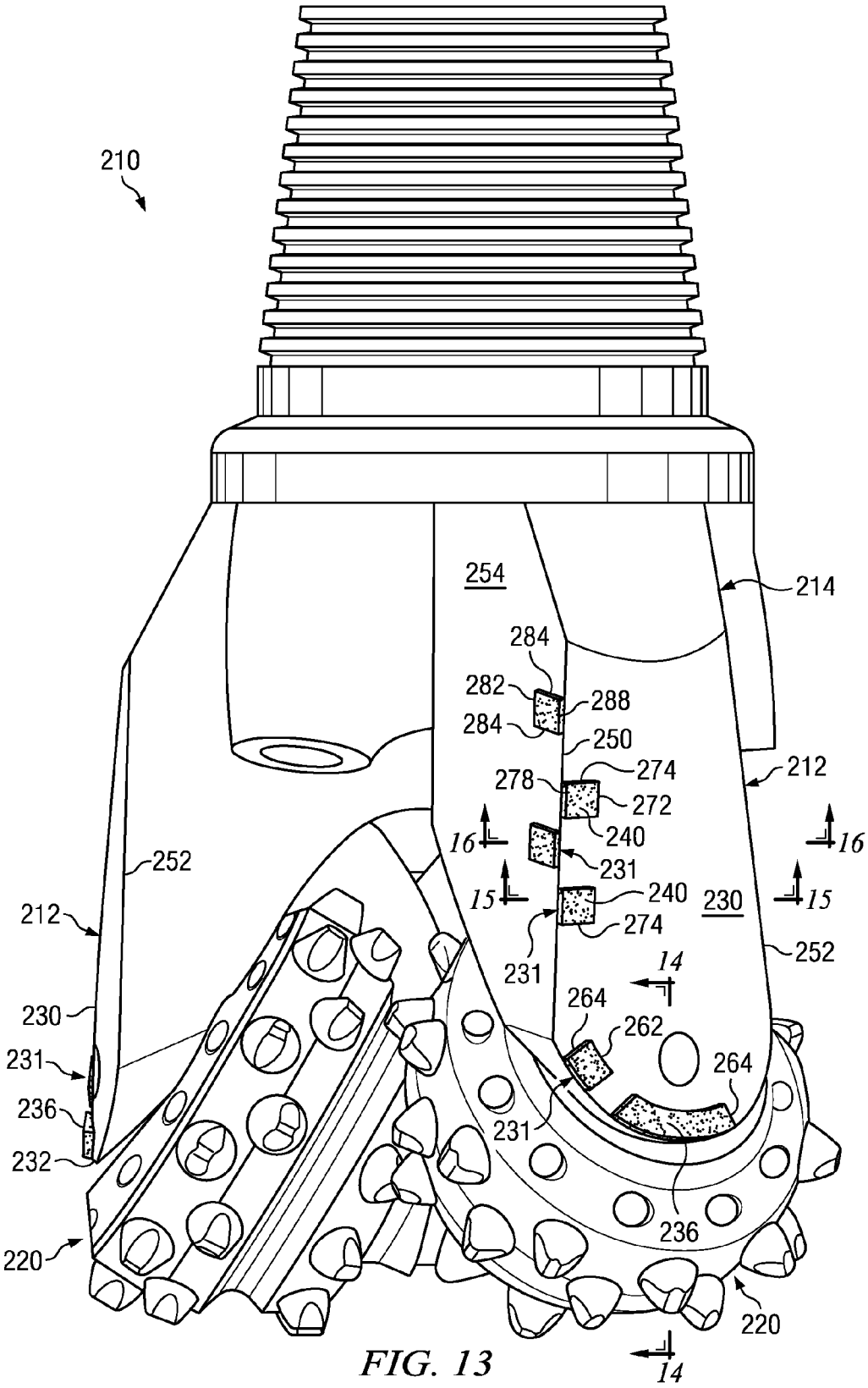
FIG. 13 illustrates an isometric view of a rotary cone drill bit including protection mechanisms for the shirttail edge and the leading edge of the shirttail.

Reference is now made to FIG. 13 which illustrates an isometric view of a rotary cone drill bit 210 including protection mechanisms for the shirttail edge and the leading edge of the shirttail. A leg 212 depends from a body portion 214 of the drill bit 210. The leg 212 includes a bearing shaft (not shown, see FIG. 14 reference 216) which extends in a downward and radial inward direction. A cutter cone 220 is mounted to the bearing shaft and supported thereon for rotation. The outer surface 230 of the leg 212 terminates at a semicircular edge 232 proximal to the cone 220. The region of the leg 212 associated with the surface 230 is known in the art as the "shirttail region," and the edge 232 is known in the art as the "shirttail edge." The outer surface 230 of the leg 212 laterally terminates at a leading shirttail edge 250 and a trailing edge 252 of the shirttail. The leading edge 250 and a trailing edge 252 of the shirttail comprise extensions of the shirttail edge 232 extending along the length of the leg 212. The shirttail region further includes a leading side surface 254 which is adjacent the outer surface 230 of the leg 212 at the leading shirttail edge 250. Although illustrated for example as including a sealed bearing system, it will be understood that the present invention is applicable to both sealed and non-sealed (air) bearing bits.

To protect the shirttail edge 232, a hard plate 236 is adhered to a floor surface 231 provided in or by the curved outer surface 230 of the leg 212 extending inwardly from the shirttail edge 232. See, also, FIG. 14. To protect the leading edge 250 of the shirttail, a hard plate 240 is adhered to a floor surface 231 provided in or by the curved outer surface 230 of the leg 212 extending inwardly from the leading edge 250 of the shirttail. See, also, FIG. 15. To protect the leading side surface 254, a hard plate 244 is adhered to a floor surface 231 provided in or by the leading side surface 254 of the leg 212 extending outwardly from the leading edge 250 of the shirttail. See, also, FIG. 16. Although all three protection mechanisms are illustrated in FIG. 13, it will be understood that any one or more of the protection mechanisms may be selected for use on the rotary cone drill bit 210. The floor surfaces 231 are preferably machined or cast into the outer surfaces of the shirttail region along the edge 232 and edge 250, and may have flat or curved surface geometries as desired and which conform with the bottom surfaces of the plates 236, 240 and 244.

Although FIG. 13 primarily illustrates the use of polygonal plates, it will be understood that the plates can have any desired shape (including circular shapes, oval shapes, and the like). Furthermore, as shown in FIG. 13, the plates can be of different sizes, perhaps with size selection depending on placement position.

Although FIG. 13 illustrates the use of several hard plates 236 along the shirttail edge 232, it will be understood that one plate 236 could instead be provided extending along all or a portion of the shirttail edge 232. Although FIG. 13 illustrates the use of several hard plates 240 along the leading edge 250 of the shirttail, it will be understood that one plate 240 could instead be provided extending along all or a portion of the leading edge 250 of the shirttail. Although FIG. 13 illustrates the use of several hard plates 244 along the leading edge 250 of the shirttail, it will be understood that one plate 244 could instead be provided extending along all or a portion of the leading edge 250 of the shirttail. In each of the foregoing implementations, the portion of the edge (shirttail edge 232 and/or leading shirttail edge 250) selected to receive protection would be that portion of the edge which is most susceptible to wear during operation of the rotary cone drill bit 210.

Figure 14:
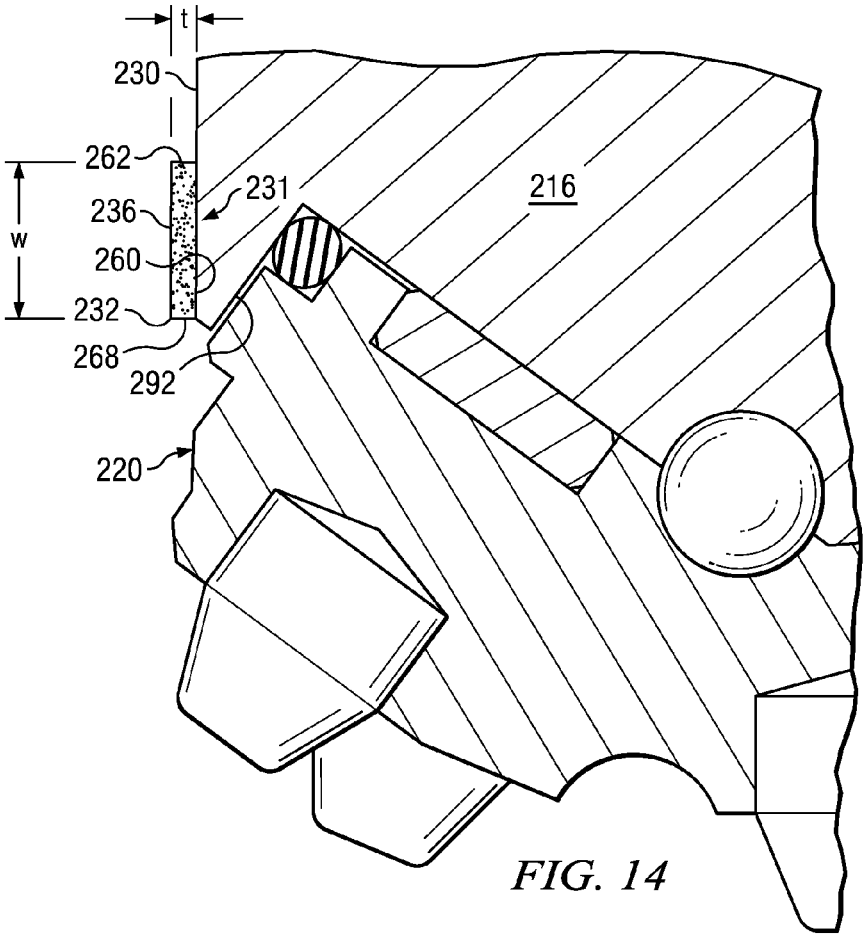
FIG. 14 illustrates a cross-sectional view of a portion of a leg of a rotary cone drill bit which includes an embodiment of a shirttail edge protection mechanism.

Reference is now made to FIG. 14 which illustrates a cross-sectional view of a portion of a leg of a rotary cone drill bit which includes an embodiment of a shirttail edge protection mechanism. In this embodiment, the bottom surface 260 of the hard plate 236 is adhered to a substantially conforming floor surface 231 provided in or by the curved outer surface 230 of the leg 212 and extending inwardly from the shirttail edge 232. The plate 236 is further defined by a rear edge 262 and two side edges 264 (see, also, FIG. 13). The means for adhering the bottom surface to the floor surface may, for example, comprise any suitable adhering material which is interposed between the substantially conforming (for example, parallel) surfaces including adhesive material flowable between the substantially parallel surfaces by capillary action such as a brazing material, solder, adhesives, resins, and the like (see, for example, U.S. Patent Application Publication No. 2009/0038442, the disclosure of which is hereby incorporated by reference). Because of drawing scale, the adhesive material is not explicitly shown in FIG. 14, but it will be understood that the adhesive material is present between the bottom surface and the outer surface. The adhesive material preferably has a substantially uniform thickness between the conforming bottom surface and floor surface. The hard plate 236 is sized such that its front edge 268 defines (or is coincident with or is nearly coincident with) the shirttail edge 232. The thickness of the plate 236 may range from 0.050 to 0.500 inches. The hard plate 236 is made of a material or combination of materials which are more abrasion resistant than the material used to make the leg and shirttail of the bit. In a preferred implementation, the hard plate is made of a material such as tungsten carbide, PDC, polycrystalline cubic boron nitride compactimpregnated diamond segment, and the like. These materials are superior to the traditional weld on tungsten carbide hardfacing known in the prior art because they are denser and are not as susceptible to abrasion and erosion. The conforming surfaces where adhesion takes place may curve, for example, with the radius of the bit, or have any selected curved configuration.

The shirttail edge 232 is provided where the terminal portion of the surface 230 transitions to an inside radial surface 292 oriented parallel to the base of the cone 220 (perpendicular to the bearing shaft 216) and positioned at the base of the bearing shaft 216. The hard plates 236 function to protect against wearing of the shirttail edge 232 and erosion of the inside radial surface 292. Although a sealed bearing system is illustrated, it will be understood that edge protection in accordance with the present invention is applicable to both sealed and non-sealed (air) bearing bits.

The hard plates 236 have a thickness t and width w (wherein the width is measured in a direction perpendicular to the shirttail edge 232). The hard plates 236 are thin inserts. In this case, a ratio of the thickness t of the plate to a width w of the plate is less than 0.5 (i.e., $t/w<0.5$). More particularly, the ratio of the thickness t of the plate to the width w of the plate is substantially less than 0.5 (i.e., $t/w<<0.5$). Even more particularly, the ratio of the thickness t of the plate to the width w of the plate is less than 0.2 (i.e., $t/w<0.2$), and may even be less than 0.1 (i.e., $t/w<0.1$).

Figure 17:
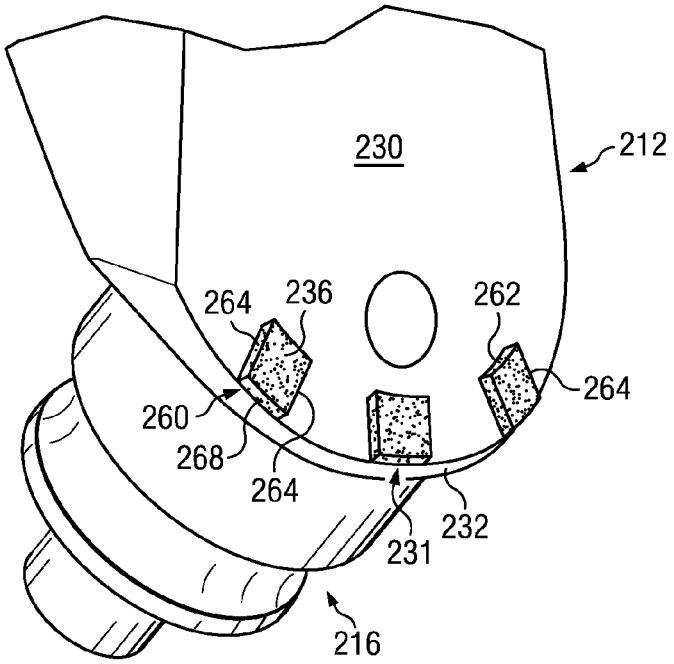
FIGS. 17 and 18 illustrate isometric views of a portion of the leg and including protection mechanisms for the shirttail edge.
Figure 18:
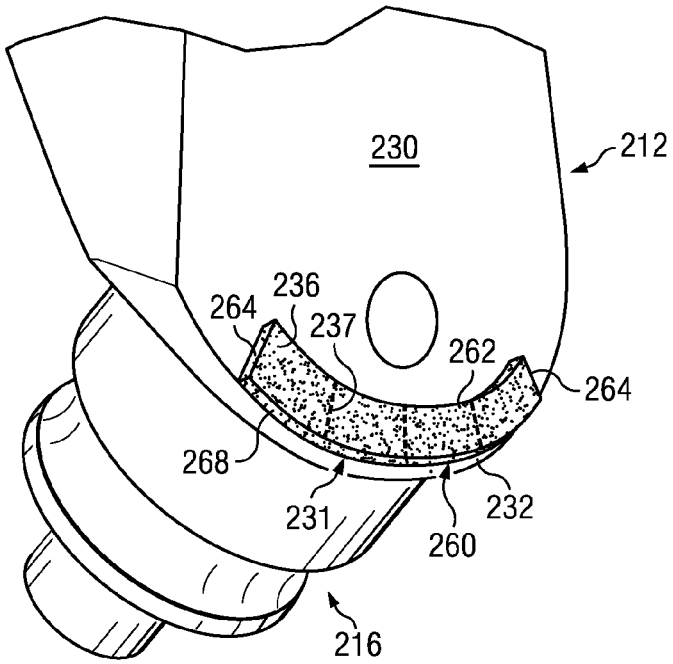

FIGS. 17 and 18 illustrate isometric views of a portion of the leg 230 and including protection mechanisms for the shirttail edge 232 as shown in FIG. 13. The cone 220 has been omitted from FIGS. 17 and 18 to show how the hard plates 236 are positioned at the shirttail edge. 232. It is at the floor surface 231 formed in or by outer surface 230 where adhesion (for example, through brazing) is made to the conforming bottom surface 260 of each hard plate 236. In this way, the adhesive material is not externally exposed and subject to possible wear.

As shown in FIG. 18, protection is desired to extend in a continuous manner along an extended length of the shirttail edge 232. In one embodiment, the floor surface may curve with the radius of the bit, and thus the bottom surface of the one or more included plates will have a conforming curve. In another embodiment, the floor surface is formed to include a plurality of substantially flat and adjacent floor surfaces 260, and a hard plate 236 with a conforming flat bottom surface is provided for each flat surface and plates are arranged in a tiled edge-to-edge configuration (see, dotted line reference 237 indicating adjacent tile edges).

Figure 15:
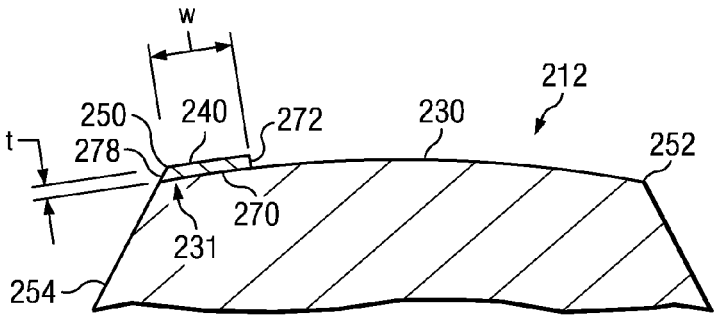
FIGS. 15 and 16 illustrate cross-sectional views of a portion of a leg of a rotary cone drill bit which include embodiments of a mechanism for protecting the leading edge of the shirttail.

Reference is now made to FIG. 15 which illustrates a cross-sectional view of a portion of a leg of a rotary cone drill bit which includes an embodiment of a protection mechanism for the leading edge of the shirttail. In this embodiment, the bottom surface 270 of the hard plate 240 is adhered to a substantially conforming floor surface 231 formed in or by the outer surface 230 of the leg 212 and extending inwardly from the leading shirttail edge 250. The plate 240 is further defined by a rear edge 272 and two side edges 274 (see, also, FIG. 13). The means for adhering the bottom surface to the floor surface may, for example, comprise any suitable adhering material which is interposed between the substantially conforming (for example, parallel) surfaces including adhesive material flowable between the substantially conforming surfaces by capillary action such as a brazing material, solder, adhesives, resins, and the like (see, for example, U.S. Patent Application Publication No. 2009/0038442, the disclosure of which is hereby incorporated by reference). Because of drawing scale, the adhesive material is not explicitly shown in FIG. 15, but it will be understood that the adhesive material is present between the bottom surface and the flattened surface. The adhesive material preferably has a substantially uniform thickness between the conforming bottom surface and floor surface. The hard plate 240 is sized such that its front edge 278 defines (or is coincident with, or is nearly coincident with) the leading edge 250 of the shirttail. The thickness of the plate 240 may range from 0.050 to 0.500 inches. The hard plate 240 is made of a material or combination of materials which are more abrasion resistant than the material used to make the leg and shirttail of the bit. In a preferred implementation, the hard plate is made of a material such as tungsten carbide, PDC, polycrystalline cubic boron nitride compactimpregnated diamond segment, and the like. These materials are superior to the traditional weld on tungsten carbide hardfacing known in the prior art because they are denser and are not as susceptible to abrasion and erosion. Again, the adhesive material is this implementation is not externally exposed and subject to possible wear. The conforming surfaces where adhesion takes place may curve, for example, with the radius of the bit, or have any selected curved configuration.

The hard plates 240 have a thickness t and width w (wherein the width is measured in a direction perpendicular to the leading edge 250). The hard plates 240 are thin inserts. In this case, a ratio of the thickness t of the plate to a width w of the plate is less than 0.5 (i.e., $t/w<0.5$). More particularly, the ratio of the thickness t of the plate to the width w of the plate is substantially less than 0.5 (i.e., $t/w<<0.5$). Even more particularly, the ratio of the thickness t of the plate to the width w of the plate is less than 0.2 (i.e., $t/w<0.2$), and may even be less than 0.1 (i.e., $t/w<0.1$).

Figure 16:
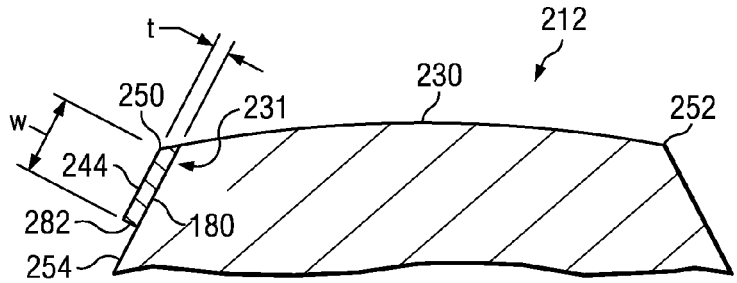

Reference is now made to FIG. 16 which illustrates a cross-sectional view of a portion of a leg of a rotary cone drill bit which includes an embodiment of a protection mechanism for the leading edge of the shirttail. In this embodiment, the bottom surface 280 of the hard plate 244 is adhered to a substantially conforming floor surface 231 formed in or by the leading surface 254 of the leg 212 and extending outwardly from the leading shirttail edge 250. The plate 244 is further defined by a rear edge 282 and two side edges 284 (see, also, FIG. 13). The means for adhering the bottom surface to the floor surface may, for example, comprise any suitable adhering material which is interposed between the substantially conforming (for example, parallel) surfaces including adhesive material flowable between the substantially conforming surfaces by capillary action such as a brazing material, solder, adhesives, resins, and the like (see, for example, U.S. Patent Application Publication No. 2009/0038442, the disclosure of which is hereby incorporated by reference). Because of drawing scale, the adhesive material is not explicitly shown in FIG. 16, but it will be understood that the adhesive material is present between the bottom surface and the flattened surface on the leading side surface. The adhesive material preferably has a substantially uniform thickness between the conforming bottom surface and floor surface. The hard plate 244 is sized such that its front edge 288 defines (or is coincident with, or is nearly coincident with) the leading edge 250 of the shirttail. The thickness of the plate 244 may range from 0.050 to 0.500 inches. The hard plate 244 is made of a material or combination of materials which are more abrasion resistant than the material used to make the leg and shirttail of the bit. In a preferred implementation, the hard plate is made of a material such as tungsten carbide, PDC, polycrystalline cubic boron nitride compactimpregnated diamond segment, and the like. These materials are superior to the traditional weld on tungsten carbide hardfacing known in the prior art because they are denser and are not as susceptible to abrasion and erosion. Again, the adhesive material is this implementation is not externally exposed and subject to possible wear. The conforming surfaces where adhesion takes place may curve, for example, with the radius of the bit, or have any selected curved configuration.

The hard plates 244 have a thickness t and width w (wherein the width is measured in a direction perpendicular to the leading edge 250). The hard plates 244 are thin inserts. In this case, a ratio of the thickness t of the plate to a width w of the plate is less than 0.5 (i.e., $t/w<0.5$). More particularly, the ratio of the thickness t of the plate to the width w of the plate is substantially less than 0.5 (i.e., $t/w<<0.5$). Even more particularly, the ratio of the thickness t of the plate to the width w of the plate is less than 0.2 (i.e., $t/w<0.2$), and may even be less than 0.1 (i.e., $t/w<0.1$).

It will be noted that the hard plates may be of any selected geometry thus allowing for the application of protection to complex surfaces of the bit.

The illustration of protection being applied using plates at the shirttail edge and/or leading shirttail edge is by way of example only, it being understood that the protection mechanisms described can be applied to any edge of the bit that are susceptible to wear.

Although preferred embodiments of the method and apparatus have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A rotary cone drill bit, comprising:

a body;

a leg depending from the body;

a bearing shaft extending from the leg;

a cone mounted to the bearing shaft;

wherein the leg terminates at a shirttail edge adjacent a base of the cone;

a preformed hard material plate having an edge and a bottom surface; and an adhesive material attaching the bottom surface of the hard material plate to a substantially conforming surface of the leg, wherein the edge of the hard material plate defines at least a portion of the shirttail edge.

2. The bit of claim 1 wherein the leg includes an outer surface, and the bottom surface of the hard material plate is attached by the adhesive material to a conforming floor surface formed in or by the outer surface of the leg.

3. The bit of claim 2 wherein the adhesive material attaching the bottom surface of the hard material plate to the floor surface of the leg comprises a flowable adhesive material interposed between the bottom surface of the hard material plate and the floor surface of the leg.

4. The bit of claim 3 wherein the flowable adhesive material is a brazing material.

5. The bit of claim 1 wherein the leg includes an outer surface, and a slot is provided in the outer surface extending inwardly from the shirttail edge, the slot being open at the shirttail edge and including a floor surface, and wherein the bottom surface of the hard material plate is attached by the adhesive material to the floor surface provided by the slot in the outer surface of the leg.

6. The bit of claim 5 wherein the adhesive material attaching the bottom surface of the hard material plate to the floor surface of the slot comprises a flowable adhesive material interposed between the bottom surface of the hard material plate and the floor surface of the slot.

7. The bit of claim 6 wherein the flowable adhesive material is a brazing material.

8. The bit of claim 1 wherein the hard material plate has width w and a thickness t, wherein a ratio $t/w<0.5$.

9. The bit of claim 1 wherein the hard material plate is made of solid tungsten carbide.

10. The bit of claim 1 wherein the hard material plate is one of a polycrystalline diamond compact or an impregnated diamond segment.

11. The bit of claim 1 wherein the hard material plate is a polycrystalline cubic boron nitride compact.

12. The bit of claim 1 wherein the hard material plate is thin and includes a substantially flat top surface.

13. The bit of claim 1 wherein a top surface of the hard material plate is substantially flush with an outer surface of the leg.

14. The bit of claim 1 wherein the preformed hard material plate is at least one preformed hard material plate and at least a portion of the shirttail edge comprises a majority of the shirttail edge.

15. The bit of claim 1 wherein the hard material plate is a tile.

16. The bit of claim 15 further comprising a plurality of adjacent tiles.

17. The bit of claim 16 wherein the plurality of adjacent tiles is a plurality of spaced apart, adjacent tiles.

18. A rotary cone drill bit, comprising:

a body;

a leg depending from the body;

a bearing shaft extending from the leg;

a cone mounted to the bearing shaft;

wherein the leg includes a lateral leading edge;

a preformed hard material plate having an edge and a bottom surface; and an adhesive material attaching the bottom surface of the hard material plate to a substantially conforming surface of the leg, wherein the edge of the hard material plate defines at least a portion of the lateral leading edge.

19. The bit of claim 18 wherein the leg includes a leading side surface and an outer surface adjacent thereto at the lateral leading edge, and the bottom surface of the hard material plate is attached by the adhesive material to a conforming floor surface formed in or by the outer surface of the leg.

20. The bit of claim 19 wherein the adhesive material attaching the bottom surface of the hard material plate to the floor surface of the leg comprises a flowable adhesive material interposed between the bottom surface of the hard material plate and the floor surface of the leg.

21. The bit of claim 20 wherein the flowable adhesive material is a brazing material.

22. The bit of claim 18 wherein the leg includes a leading side surface and an outer surface adjacent thereto at the lateral leading edge, and a slot is provided in the outer surface extending inwardly from the lateral leading edge, the slot being open at the lateral leading edge and including a floor surface of the leg, and wherein the bottom surface of the hard material plate is attached by the adhesive material to the floor surface provided by the slot in the outer surface of the leg.

23. The bit of claim 22 wherein the adhesive material attaching the bottom surface of the hard material plate to the floor surface of the slot comprises a flowable adhesive material interposed between the bottom surface of the hard material plate and the floor surface of the slot.

24. The bit of claim 23 wherein the flowable adhesive material is a brazing material.

25. The bit of claim 18 wherein the leg includes a leading side surface and an outer surface adjacent thereto at the lateral leading edge, and the bottom surface of the hard material plate is attached by the adhesive material to a conforming floor surface formed in or by the leading side surface of the leg.

26. The bit of claim 25 wherein the adhesive material attaching the bottom surface of the hard material plate to the leading side surface of the leg comprises a flowable adhesive material interposed between the bottom surface of the hard material plate and the floor surface of the leg.

27. The bit of claim 26 wherein the flowable adhesive material is a brazing material.

28. The bit of claim 18 wherein the leg includes a leading side surface and an outer surface adjacent thereto at the lateral leading edge, and a slot is provided in the leading side surface extending inwardly from the lateral leading edge, the slot being open at the lateral leading edge and including a floor surface of the leg, and wherein the bottom surface of the hard material plate is attached by the adhesive material to the floor surface provided by the slot in the leading side surface of the leg.

29. The bit of claim 28 wherein the adhesive material attaching the bottom surface of the hard material plate to the floor surface of the slot comprises a flowable adhesive material interposed between the bottom surface of the hard material plate and the floor surface of the slot.

30. The bit of claim 29 wherein the flowable adhesive material is a brazing material.

31. The bit of claim 18 wherein the hard material plate has width w and a thickness t, wherein a ratio $t/w<0.5$.

32. The bit of claim 18 wherein the hard material plate is made of solid tungsten carbide.

33. The bit of claim 18 wherein the hard material plate is one of a polycrystalline diamond compact or an impregnated diamond segment.

34. The bit of claim 18 wherein the hard material plate is a polycrystalline cubic boron nitride compact.

35. The bit of claim 18 wherein the hard material plate is thin and includes a substantially flat top surface.

36. The bit of claim 18 wherein a top surface of the hard material plate is substantially flush with an outer surface of the leg.

37. A rotary cone drill bit, comprising:

a body;

a leg depending from the body;

a bearing shaft extending from the leg;

a cone mounted to the bearing shaft;

wherein the leg includes a surface edge;

a preformed hard material plate having an edge and a bottom surface;

an adhesive material attaching the bottom surface of the hard material plate to a substantially conforming surface of the leg, wherein the edge of the hard material plate defines at least a portion of the surface edge of the leg.

38. The bit of claim 37 wherein the surface edge is a leading edge of a shirttail, and the bottom surface of the hard material plate is attached by the adhesive material to the conforming surface of the leg.

39. The bit of claim 38 wherein the adhesive material attaching the bottom surface of the hard material plate to the surface of the leg comprises a flowable adhesive material interposed between the bottom surface of the hard material plate and the conforming surface of the leg.

40. The bit of claim 39 wherein the flowable adhesive material is a brazing material.

41. The bit of claim 38 further comprising a slot formed in the leg extending from the leading edge, the slot being open at the leading edge and wherein the conforming surface of the leg to which the bottom surface of the hard material plate is attached is a floor surface of the slot.

42. The bit of claim 37 wherein the surface edge is a shirttail edge at an end of the leg adjacent a base of the cone, and the bottom surface of the hard material plate is attached by the adhesive material to the conforming surface of the leg.

43. The bit of claim 42 wherein the adhesive material attaching the bottom surface of the hard material plate to the surface of the leg comprises a flowable adhesive material interposed between the bottom surface of the hard material plate and the conforming surface of the leg.

44. The bit of claim 43 wherein the flowable adhesive material is a brazing material.

45. The bit of claim 42 further comprising a slot formed in the leg extending from the shirttail edge, the slot being open at the shirttail edge and wherein the conforming surface of the leg to which the bottom surface of the hard material plate is attached is a floor surface of the slot.

46. The bit of claim 37 wherein the hard material plate has width w and a thickness t, wherein a ratio $t/w<0.5$.

47. The bit of claim 37 wherein the hard material plate has width w and a thickness t, wherein a ratio $t/w<0.2$.

48. The bit of claim 37 wherein the hard material plate has width w and a thickness t, wherein a ratio $t/w<0.1$.

49. The bit of claim 37 wherein the hard material plate is thin and includes a substantially flat top surface.

50. The bit of claim 37 wherein a top surface of the hard material plate is substantially flush with an outer surface of the leg.

* * * * *

UNITED STATES PATENT AND TRADEMARK OFFICE

CERTIFICATE OF CORRECTION

PATENT NO. : 8,522,899 B2
APPLICATION NO. : 12/896406
DATED : September 3, 2013
INVENTOR(S) : Inpeng Bouaphanh It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 278 days.

-- This patent is subject to a terminal disclaimer. --

Item (45) Date of Patent should appear as follows:

-- * -- Sep. 3, 2013

Signed and Sealed this
Thirteenth Day of December, 2016

Michelle K. Lee

Michelle K. Lee
*Director of the United States Patent and Trademark Office*